US011560002B2

(12) United States Patent
Bonjoch Roma et al.

(10) Patent No.: US 11,560,002 B2
(45) Date of Patent: Jan. 24, 2023

(54) ADJUSTING TENSION OF A SUBSTRATE

(71) Applicant: Hewlett-Packard Development Company, L.P., Spring, TX (US)

(72) Inventors: Ignasi Bonjoch Roma, Sant Cugat del Valles (ES); Josep Bel Calavia, Sant Cugat del Valles (ES); Andreu Vinets Alonso, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/261,046

(22) PCT Filed: Dec. 10, 2018

(86) PCT No.: PCT/US2018/064751
§ 371 (c)(1),
(2) Date: Jan. 18, 2021

(87) PCT Pub. No.: WO2020/122858
PCT Pub. Date: Jun. 18, 2020

(65) Prior Publication Data

US 2021/0309029 A1 Oct. 7, 2021

(51) Int. Cl.
*B41J 11/46* (2006.01)
*B41J 15/16* (2006.01)
(Continued)

(52) U.S. Cl.
CPC ..... *B41J 15/16* (2013.01); *B41J 11/46* (2013.01); *B65H 23/185* (2013.01); *B65H 23/198* (2013.01); *B65H 23/1806* (2013.01); *B65H 2511/22* (2013.01); *B65H 2511/23* (2013.01); *B65H 2511/512* (2013.01); *B65H 2513/11* (2013.01); *B65H 2515/31* (2013.01);
(Continued)

(58) Field of Classification Search
CPC ..... B41J 15/16; B41J 11/46; B65H 23/185; B65H 23/198; B65H 2511/22; B65H 2511/232; B65H 2511/512; B65H 2513/11; B65H 2515/31; B65H 2553/40; B65H 2801/15; B65H 2515/842; B65H 23/1806
See application file for complete search history.

(56) References Cited

U.S. PATENT DOCUMENTS 6,499,822 B1 12/2002 Abe et al.
6,869,237 B2 3/2005 Dinca et al.
(Continued)

FOREIGN PATENT DOCUMENTS

CN 1666866 9/2005
CN 201183357 Y 1/2009
(Continued)

*Primary Examiner* — Yaovi M Ameh

(57) ABSTRACT

An example method comprises operating a drive unit to advance a substrate in a substrate advance direction toward a printing station. At the printing station, a first line is printed onto the substrate. A drive unit is instructed to advance the substrate in the substrate advance direction by a target amount, and a second line is printed onto the substrate. The distance between the first and second lines in a direction perpendicular to the substrate advance direction is calculated and, based on the calculated difference, a tension of the substrate is modified.

20 Claims, 7 Drawing Sheets

(51) Int. Cl.
*B65H 23/185* (2006.01)
*B65H 23/198* (2006.01)
*B65H 23/18* (2006.01)

(52) U.S. Cl.
CPC ..... *B65H 2515/84* (2013.01); *B65H 2553/40* (2013.01); *B65H 2801/15* (2013.01)

(56) References Cited

U.S. PATENT DOCUMENTS

| | | | | |
|---|---|---|---|---|
| 6,966,712 | B2 | 11/2005 | Trelewichz et al. | |
| 8,721,030 | B2 | 5/2014 | Chen et al. | |
| 9,372,127 | B1 | 6/2016 | Katerberg et al. | |
| 2004/0080553 | A1* | 4/2004 | Kim | B41J 25/308 347/8 |
| 2005/0117949 | A1 | 6/2005 | Waldal | |
| 2011/0153812 | A1 | 6/2011 | Yoon | |
| 2013/0021622 | A1 | 1/2013 | Yamaguchi et al. | |
| 2014/0111594 | A1* | 4/2014 | Schuh | B41J 11/66 347/218 |
| 2014/0111595 | A1 | 4/2014 | Vetterling et al. | |
| 2015/0239231 | A1 | 8/2015 | Regelsberger et al. | |
| 2018/0207957 | A1 | 7/2018 | Breintner et al. | |

FOREIGN PATENT DOCUMENTS

| | | | | |
|---|---|---|---|---|
| CN | 101811391 | | 8/2010 | |
| CN | 202081274 | U | 12/2011 | |
| CN | 102785463 | | 11/2012 | |
| CN | 103253010 | | 8/2013 | |
| CN | 204955754 | | 1/2016 | |
| CN | 207173073 | | 4/2018 | |
| CN | 108473264 | | 8/2018 | |
| GB | 1153812 | | 5/1969 | |
| JP | 11240140 | A * | 9/1999 | B41F 33/06 |
| JP | 2000191196 | | 7/2000 | |
| JP | 2001260426 | | 9/2001 | |
| JP | 2016147239 | | 8/2016 | |
| KR | 101221831 | | 1/2013 | |

* cited by examiner

ADJUSTING TENSION OF A SUBSTRATE

BACKGROUND

Some printing systems have mechanisms to adjust the tension of a substrate to be printed on.

BRIEF DESCRIPTION OF DRAWINGS

Examples will now be described, by way of non-limiting example, with reference to the accompanying drawings, in which.

DETAILED DESCRIPTION

Figure 1:
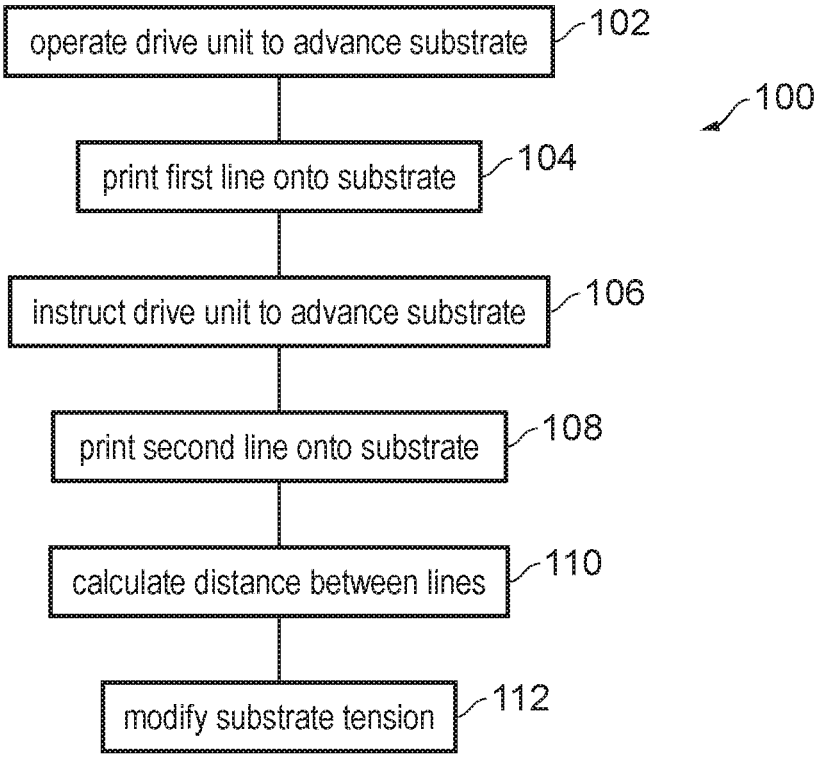
FIG. 1 is a flowchart of an example method.

In a printing operation, a printing fluid (such as ink) may be deposited onto a substrate to print an image onto the substrate. Managing the tension of the substrate may provide for a more accurate transfer of the printing fluid and a better image quality. For example, some printing systems are able to accommodate paper, plastic and fabric substrates and each substrate may be prone to different behaviours under the stresses they are put through when they advance through a printing system. Some example printing systems herein are able to accommodate various types of substrates.

Some substrates (such as fabric substrates) exhibit low rigidity under compression which can cause deformations (such as wrinkles). These can also be caused by the variability of elasticity across different types of substrates, and the difficulty for some substrates (such as fabric) to be sensed by optical sensors. For example, fabric substrates (for example, woven or knitted substrates) may have a regular structure that can be difficult to track by the algorithms of some sensors. Fabric substrates can also exhibit different levels of elasticity depending on the composition of the substrate, and the print quality can be highly sensitive to variations in the control settings of the printing system. Such systems may have manual adjustment mechanisms to alter the substrate tension, and a user with a high degree of expertise may finely tune the system to a target tension, or they may use print modes with a high number of passes, which can reduce the productivity of the overall system.

Some examples herein relate to a printing system in which a drive unit advances a substrate under a print carriage. In these example systems the drive unit advances the substrate from an input roller (or unwind roller) toward an output roller (or rewind roller) and through a printing station therebetween. Accordingly, the substrate may have first and second, or input and output, tensions—the input tension being the substrate tension between the input roller and the drive roller, and the output tension being the substrate tension between the drive roller and the output roller. The output roller may function to apply sufficient tension so that the substrate properly advances out of the printing station, particularly for substrates exhibiting low rigidity under compression.

If the input tension is greater than the output tension then the wrinkles can occur in the substrate which, if not corrected for, could adversely affect the print quality. These can occur, for example, when the substrate crosses the pinch created by small free rollers which press the substrate to the drive roller. For example, "pinch" rollers may be spring biased to press the substrate to the drive roller, as without the force and traction provided by this pinch the substrate may slip when the drive roller turns to advance the substrate. In some examples, pinch rollers may be arranged along the width of the drive roller and therefore the width of the substrate. When crossing this "pinch", e.g. when crossing from an input side of the drive roller to an output side of the drive roller, the substrate may exhibit different tensions in each region. For example, if the input tension is greater than the output tension then the substrate may not be sufficiently "pulled" toward the output roller and so may wrinkle when it exits the printing station. If the output tension is greater than the input tension then the substrate may be sufficiently "pulled" toward the output roller such that any wrinkles in the substrate are effectively pulled out of the substrate. Therefore, in some examples, a greater output tension than input tension may reduce the presence of wrinkles in the substrate.

On the other hand, if the output tension is too high then this could cause advance errors, which can lead to horizontal banding, e.g. banding in the perpendicular direction to the substrate-advance direction (which is also known as the "crossweb" direction), since an increased output tension may cause the print zone to contract in the crossweb direction, and expand in the advance direction. Advance errors in the drive unit advancing the substrate may also cause horizontal banding when there is too large a difference between the expected and actual substrate advance, or when an expansion and stretch in the advance direction causes the ink drops to be misplaced during passes of the print carriage.

Some examples herein relate to printing a mark, which may comprise a line, onto a substrate and then advancing the substrate an "expected" distance. For example, the substrate may be programmed to advance by 1 inch but, due to advance errors or wrinkles—which, as above, may be caused by an incorrect ratio between input and output tensions—the substrate may not actually advance by the programmed amount. Some examples herein relate to printing a second mark on the substrate once it has advanced, measuring the actual distance between the marks and then comparing it to the "expected" distance, the distance that the substrate was programmed to advance. If these are equal then there is no advance error and the substrate has moved exactly the amount that it was programmed to. On the other hand, if there is a greater separation between marks than the distance the substrate was programmed to advance then there has been a so-called "over-advance" (the distance between the actual advance and the programmed advance being positive), and if there is less separation between marks than the distance the substrate was programmed to advance then there has been a so-called "under-advance" (the distance between the actual advance and the programmed advance being negative). An over-advance may indicate that the output tension is above the input tension (this could either be an ideal tension ratio, or a too-high output tension which could cause advance errors and horizontal banding) whereas an under-advance may indicate that the input tension is above the output tension (this could indicate that wrinkles may occur if not corrected, and vertical banding due to the wrinkles).

As a greater output than input tension may mean that no wrinkles should occur some examples herein relate to comparing the measured difference to a threshold, the threshold being indicative of an amount to ensure an over-advance (and hence a greater output tension). Some examples herein relate to adjusting the substrate tension until there is an over-advance, which may ensure no wrinkles and therefore no vertical banding (may ensure the substrate is sufficiently stretched) but not necessarily no horizontal banding (since there may be an increased output tension or an advance error). Some examples herein relate to comparing the measured difference to a second threshold, which may be indicative of a maximum acceptable over-advance, and adjusting the substrate tension until the difference is under this second threshold. Some examples relate to adjusting the substrate tension until the difference is below this second threshold, which may ensure that the substrate tension is within a range where the printing system (e.g. the drive roller) may be calibrated to remove banding resulting from the over-advance. Therefore, some examples herein relate to adjusting the tension until the difference is above one threshold and below another, thereby being in a target range. A difference within this target range may represent a substrate that is at a tension to calibrate the printing system so that it may compensate. Some examples herein therefore relate to calibrating the printing system when the difference is within the target range so as to correct advance errors in the printing system.

Some examples herein relate to adjusting one of the input/output tensions. If the measured difference is under the first threshold (indicating under-advance), some examples herein attempt to correct this by reducing the input tension or increasing the output tension. Some examples reduce the input tension if it is above a minimum value, and increase the output tension otherwise. If the measured difference is over the second threshold (indicating an unacceptable over-advance), some examples herein attempt to correct this by reducing the output tension or increasing the input tension. Some examples reduce the output tension if it is above a minimum value, and increase the input tension otherwise.

As will be explained below, these type of adjustments maybe sequentially performed so that the measured difference is within a target range. When it is within the target range, the printing system (e.g. a drive unit thereof) may be calibrated, since the tension tuning may give rise to advance errors, so these may be corrected for once the tension values are set to target levels.

FIG. 1 shows an example method 100. The method 100 may be a method of adjusting substrate tension, e.g. adjusting substrate tension in a printing system. The method 100 may be a method of calibrating a print system.

The method 100 comprises, at block 102, operating a drive unit to advance a substrate in a substrate advance direction toward a printing station. Block 102 may comprise operating a drive unit to unwind a substrate from a substrate unwind, or an input roller. Block 102 may therefore comprise operating a drive unit to advance a substrate from an unwind roller toward a printing station.

The method 100 comprises, at block 104, printing, at the printing station, a first line onto the substrate. The first line may be printed in a single pass of a printhead carriage of the printing station. The first line may be printed at an angle to the substrate advance direction, for example the first line may be printed at an angle of 45 degrees to the substrate advance direction.

The method 100 comprises, at block 106, instructing a drive unit to advance the substrate in the substrate advance direction by a target amount. Therefore, at block 106, the method 100 comprises advancing the substrate an amount corresponding to a target, or a programmed, amount. Block 106 therefore comprises advancing the substrate by an amount that should be equal to the target (or programmed or instructed) amount in the absence of substrate deformations or advance errors. For example, the substrate may be instructed (by instructing the drive unit) to advance 1 inch. However, due to errors the substrate may actually advance 1 inch±δ, with δ being the 'error', or the difference between the actual amount the substrate has advanced and the amount it was instructed to advance. If δ is zero then the substrate has advanced the amount instructed.

The method 100 comprises, at block 108, printing a second line onto the substrate. At block 108 the method 100 therefore comprises printing a line onto the substrate, offset from the first line in the substrate advance direction by the amount that the substrate has advanced. The second line may be printed in a single pass of a printhead carriage of the printing station. The second line may be printed at an angle to the substrate advance direction, for example the second line may be printed at an angle of 45 degrees to the substrate advance direction. The second line may be parallel to the first line.

The method 100 comprises, at block 110, calculating the distance between the first and second lines in a direction perpendicular to the substrate advance direction. The distance calculated in block 110 may be used to calculate the actual distance advanced by the substrate. For example, when the two lines are both printed at 45 degrees to the substrate advance direction these distances will be the same. For example, when both lines are at 45 degrees to the substrate advance direction (and therefore the perpendicular direction), their separation in both directions will be equal.

Block 110 may comprise sensing the distance between the lines via a sensor disposed on a printhead carriage of the printing station.

The method 100 comprises, at block 112, modifying the tension of the substrate based on the difference between the target amount and the calculated difference. As will be explained below, block 112 may comprise modifying the input tension, the output tensions or both tensions of the substrate in order to adjust the tension in the substrate. For example, block 112 may comprise modifying the input and/or output tension by, under the control of a controller, communicating a current to an associated tension adjusting device to change the torque in the axis of an unwind or rewind roller of the substrate.

Figure 2A:
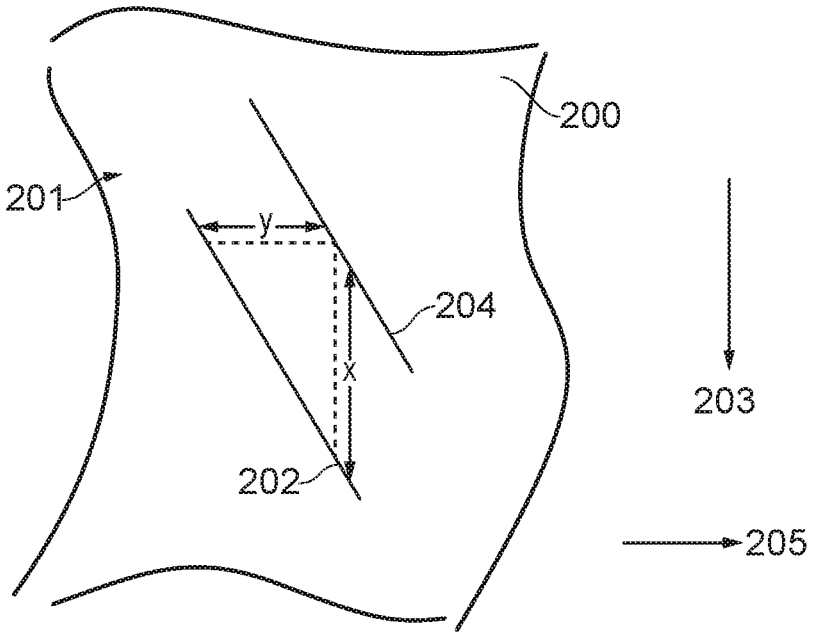
FIGS. 2A and 2B are simplified schematics of example substrates.

FIG. 2A shows an example pattern 201 printed onto the substrate 200, e.g. by the method 100. A first line 202 is printed onto the substrate 200 which is then advanced in a substrate advance direction 203 after which a second line 204 is printed onto the substrate 200. Each line in this example is printed at 45 degrees to the substrate advance direction 203. When the drive unit (e.g. in block 106 of method 100) is instructed to advance the substrate by a target amount the actual distance advanced by then substrate will be the distance (or separation), denoted x in FIG. 2A between the two lines 202, 204. As explained above, if there are no errors (advance errors or otherwise) then x may be equal to the amount the drive unit was instructed to advance the substrate by, and otherwise there will be a difference between this amount and the actual advance distance x. As the two lines 202, 204 are each at 45 degrees to the substrate advance direction 203, their separation y in the perpendicular direction to the substrate advance direction (hereafter the "cross-web direction") 205 will be equal to their separation x in the substrate advance direction 203. As the two lines 202, 204 are also parallel the distances x and y may be measured at any point along the lines.

Figure 3A:
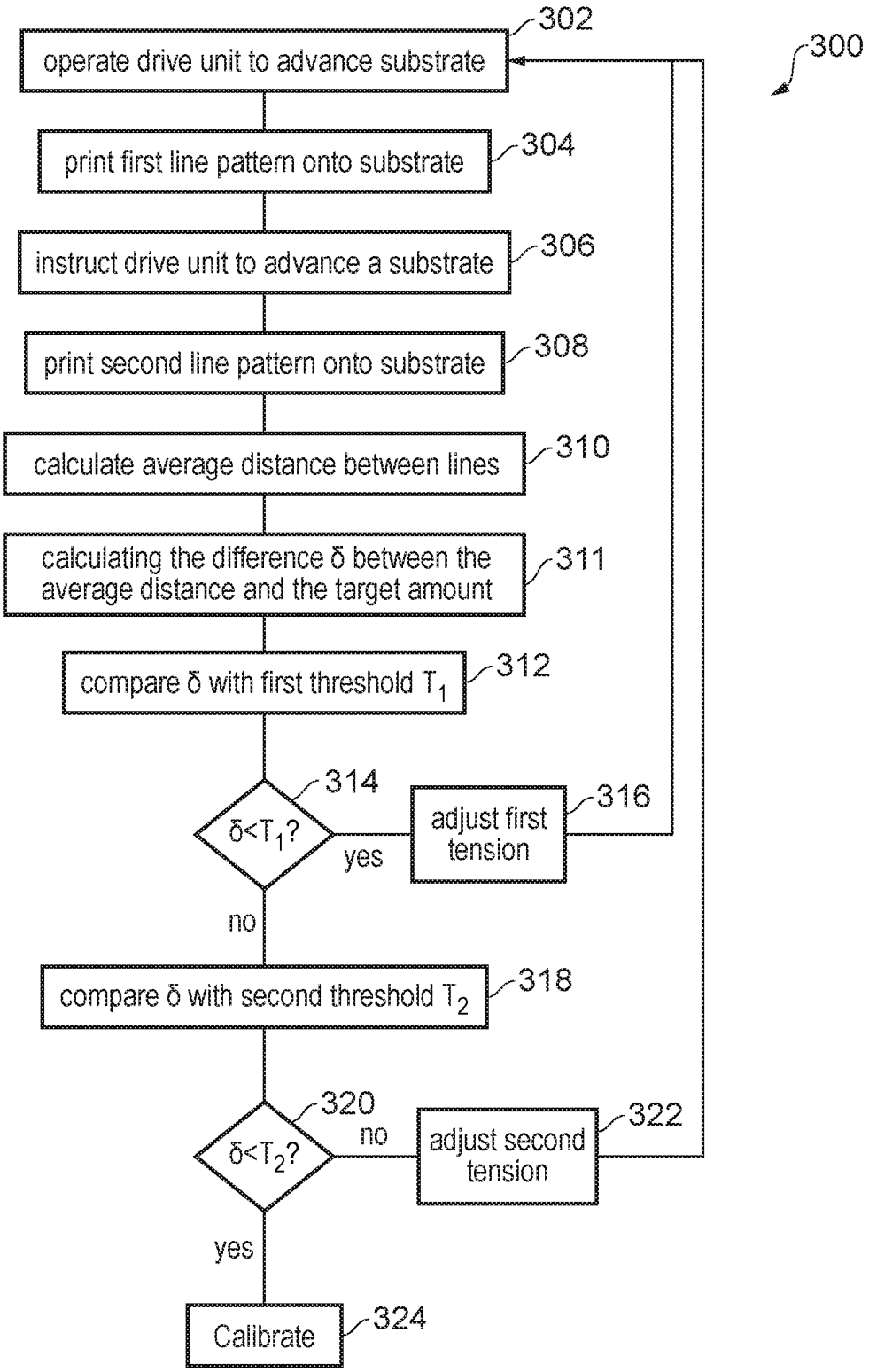
FIG. 3A is a flowchart of an example of a method.

FIG. 3A depicts an example method 300. The method 300 may be a method of adjusting substrate tension, e.g. adjusting substrate tension in a printing system. The method 300 may be a method of calibrating a print system.

The method 300 comprises, at block 302, operating a drive unit to advance a substrate in a substrate advance direction toward a printing station. Block 302 may comprise operating a drive unit to unwind a substrate from a substrate unwind, or an input roller. Block 302 may therefore comprise operating a drive unit to advance a substrate from an unwind roller toward a printing station.

The method 300 comprises, at block 304, printing, at the printing station, a first line pattern onto the substrate. The first line pattern may be a pattern of lines printed along the width (or distance perpendicular to the substrate advance direction) of the substrate. The first line pattern may be printed in a single pass of a printhead carriage of the printing station. The first line may be a pattern of lines each printed at an angle to the substrate advance direction, for example each line in the first line pattern may be printed at an angle of 45 degrees to the substrate advance direction.

The method 300 comprises, at block 306, instructing a drive unit to advance the substrate in the substrate advance direction by a target amount.

The method 300 comprises, at block 308, printing, at the printing station, a second line pattern onto the substrate. The second line pattern may be a pattern of lines printed along the width (or distance perpendicular to the substrate advance direction) of the substrate. The second line pattern may be printed in a single pass of a printhead carriage of the printing station. The second line may be a pattern of lines each printed at an angle to the substrate advance direction, for example each line in the second line pattern may be printed at an angle of 45 degrees to the substrate advance direction. The first and second line patterns may therefore be parallel.

Although in the example of FIG. 3A two patterns of lines are described, each line pattern may comprise a single line. In this respect, in one example, blocks 304 and 308 of the method 300 may each comprising printing a single line.

The method 300 comprises, at block 310, calculating the average distance between the lines in the first and second line patterns. For example (and as will be described later with reference to FIG. 2B), block 310 may comprise calculating a distance between a first line in the first line pattern and a first line in the second line pattern, the distance between a second line in the first line pattern and a second line in the second line pattern etc. These calculated distances may then be averaged to obtain the average distance at block 310. Therefore, block 310 may serve to mitigate against a particularly large distortion of the substrate in one isolated area (causing a larger discrepancy between the expected advance amount and the actual advance amount) by taking the average (e.g. the average across the substrate width).

Although average distances are depicted in this example, the method 300 may, in another example, print a single first and single second line in which case the distance at block 310 may not be an average distance but the distance between the first and second lines.

The method 300 then advances to block 311 in which the difference δ between the average distance and the target amount is calculated.

The method 300 then advanced to block 312 in which the difference δ is compared to a first threshold T1. If, at block 314, the difference δ is less than the first threshold then the method advances to block 316 in which a first tension is adjusted. The first tension, adjusted at block 316, may be a tension of the substrate in a region of the substrate prior to the printing station. The first tension may therefore be an 'input tension'. In one example, block 316 comprises reducing the first tension.

Once the input tension is adjusted at block 316 the method 300 advances to block 302 (in one example, block 304) and, as indicated by the looping arrow, blocks 302-312 of the method 300 repeat. Therefore, in this example, the input tension is adjusted until the difference is greater than the first threshold.

If, at block 314, it is determined that the difference δ is not less than the first threshold then the method 300 advances to block 318 in which the difference δ is compared to a second threshold T2. The second threshold is greater than the first threshold. If, block 320, the difference δ is not less than the second threshold then the method advances to block 322 in which a second tension is adjusted. The second tension, adjusted at block 322, may be a tension of the substrate in a region of the substrate after to the printing station. The second tension may therefore be an 'output tension'. In one example, block 322 comprises reducing the second tension.

Once the output tension is adjusted at block 322 the method 300 advances to block 302 (in one example, block 304) and, as indicated by the looping arrow, blocks 302-318 of the method 300 repeat. Therefore, in this example, the output tension is adjusted until the difference is greater than the first threshold.

Therefore, in this example both of the input and output tensions are adjusted until the difference δ is greater than the first threshold and less than the second threshold. In this example, the input and output tensions are therefore adjusted until the difference δ is within a target range, the target range being defined by the first and second thresholds.

If, at block 320, it is determined that the difference δ is less than the second threshold then the method 300 advances to block 324 at which the drive unit is calibrated. For example, at block 320 the drive unit may be calibrated so that the actual distance advanced by the substrate is equal to (or equal to within a tolerance) the instructed or programmed advance distance.

For example, the drive unit may instruct the substrate to advance by a distance D. The actual amount advanced by the substrate may be x (which will be equal to the distance between first and second lines, in examples where single lines are printed, or approximately equal to the average distance between lines in the two line patterns in examples where two line patterns are printed). The difference δ, which may therefore also be referred to as the error δ, may be defined as:

$$x-D=\delta.$$

Therefore the error is positive when the actual amount is more than the instructed amount, and negative when the actual amount is less than the instructed amount. Therefore, $\delta>0$ for an over-advance and $\delta<0$ for an under-advance.

This may define an "advance factor" A according to the relation:

$$(D+\delta)=D(1-A)$$

The advance factor A may therefore be given by:

$$A=1-((D+\delta)/D)$$

In some examples, block 324 comprises calibrating the drive unit by the factor A, or a factor proportional to A. A may therefore be a parameter that compensates for the advance error.

For example, the advance factor A may be introduced into the printing system, in one example, as follows. Because there is a difference in the amount that the substrate will actually move and the amount it's instructed to move, when the drive roller is instructed to advance the substrate by D, according to this example it will advance D+δ. Therefore, the printer can correct for the advance error using the advance factor A. For example, to advance the substrate by the distance $D_{actual}$ (e.g. 1 inch) the drive roller may be programmed to advance the substrate by the following distance, $D_{program}$, (for example 1 inch±a small amount):

$$D_{program}=D_{actual}/(1-A).$$

Therefore, according to the example method 300, if at block 314 it is determined that the error is less than the first threshold, there may be an under-advance. This may be corrected for at block 316 and then blocks 302-314 are repeated to determine if the correction (at block 314) has resulted in an over-advance. Therefore, the first threshold T1 may be set so as to produce an over-advance. For example, the first threshold may be +0.1 mm. Negative values may represent under-advances, and 0 may represent no over or no under advance. However if the error is zero then the input and output tensions may be balanced. Such a situation may represent the substrate tension being finely balanced between an under and over advance and therefore the substrate in this instance may be prone to wrinkling even though there is an over-advance. Therefore, in one example the first threshold is set to be a positive value (e.g. not zero), for example a small positive value. If the adjustment at block 314 does not produce an error over the threshold then blocks 302-314 are repeated again. If the adjustment 314 produces an error over the first threshold then at blocks 318-320 the error is compared to a second threshold and it is determined whether the error is less than a second threshold. As an error above the first threshold may indicate an over-advance, the second threshold may be set so that the over-advance is not too large. Therefore, blocks 302-320 repeat (adjusting the over-advance at block 322) until the error is within the target range defined by the first and second thresholds.

In an alternate example, blocks 316 and 322 may comprise adjusting one of the first and second (input and output) tensions.

In the example of FIG. 3A, at block 310 the average distances between lines is calculated, and the average distance is subtracted from the target amount to define he error δ. However, in another example, the distances between lines may be calculated, e.g. each distance may be calculated, and each distance may be subtracted from the target amount to define a plurality of differences, or errors, δ1, . . . δn. These may then be averaged and the average distance, or error, may be used in block 311 as the difference δ for the remaining blocks of the method 300.

Figure 3B:
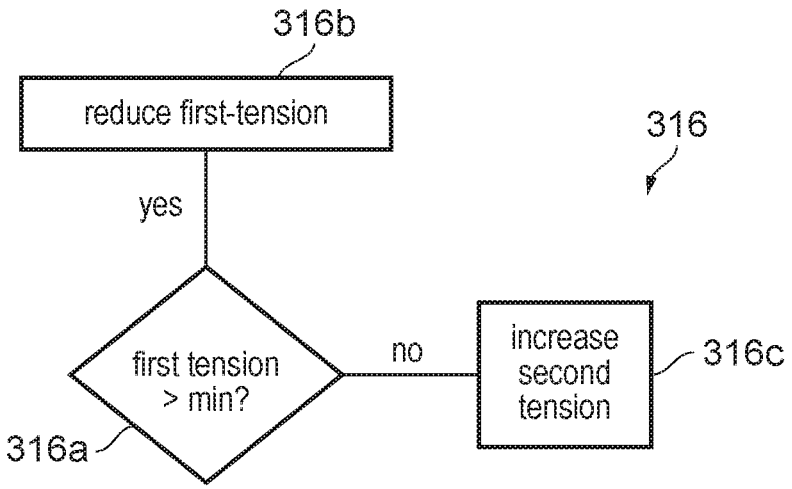
FIGS. 3B and 3C are flowcharts of example methods.

FIG. 3B shows one example implementation of block 316. In this example, at block 316*a* the first tension is compared to a minimum first tension and, if it is determined whether the first substrate tension is greater than the minimum then, at block 316*b*, the first tension is reduced. If, at block 316*a*, it is determined that the first tension is not greater than the minimum first tension, at block 316*c* the second tension is increased.

Figure 3C:
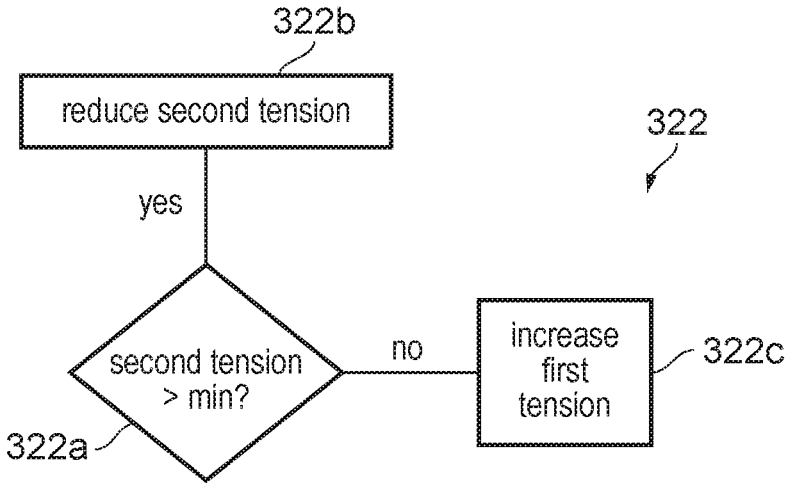

FIG. 3C shows one example implementation of block 322. In this example, at block 322*a* the second tension is compared to a minimum second tension and it is determined whether the second substrate tension is greater than the minimum then, at block 322*b*, the second tension is reduced. If, at block 322*a*, it is determined that the second tension is not greater than the minimum second tension, at block 322*c* the first tension is increased.

Therefore, in the example methods (the method 300 of FIG. 3A in conjunction with the examples of FIGS. 3B and 3C), tension may be reduced so that the tension is within a target amount, but if that tension is not at or below a minimum acceptable value. Accordingly, the minimum tensions in FIGS. 3B and 3C may be minimum acceptable amounts.

Figure 2B:
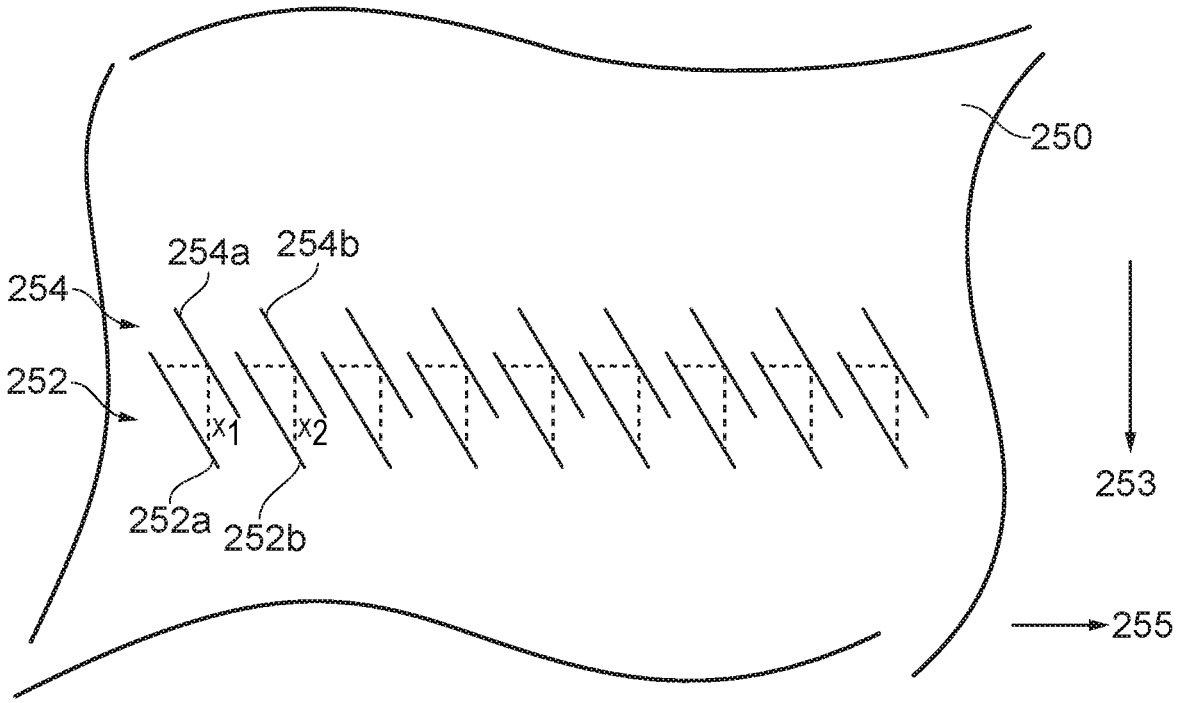

FIG. 2B shows an example substrate 250. A first line pattern 252 and a second line pattern 254 are printed onto the substrate 250, e.g. by the method 300. The first line pattern 252 comprises lines 252*a*, 252*b*, etc. and the second line pattern 254 comprises lines 254*a*, 254*b*, etc. Each line pattern comprises lines at 45 degrees to the substrate advance direction 253. Each line pattern comprises lines printed the width (the direction 255, perpendicular to the substrate advance direction 253) of the substrate. Therefore each line pattern comprises lines spaced apart in the direction 255.

When the drive unit (e.g. in block 306 of method 300) is instructed to advance the substrate by a target amount the actual distance advanced by then substrate will be the distance (or separation), denoted x1, x2, etc. in FIG. 2B between the lines 252*a*, 254*a* in the two line patterns 252, 254. As explained above, if there are no errors (advance errors or otherwise) then each of x1, x2, etc. may be equal to the amount the drive unit was instructed to advance the substrate by, and otherwise there will be a difference between this amount and the actual advance distance. The actual advance distances may vary along the width of the substrate and therefore an average distance may be taken. To measure the distance, as each line in the two patterns are at 45 degrees to the substrate advance direction 253, their separation y1, y2, etc. in the direction 255 will be equal to their separation x1, x2, etc. in the substrate advance direction 253. As the two lines 202, 204 are also parallel the distances x and y may be measured at any point along the lines. Hence, the distances y1, y2, etc. may be measured, e.g. by a sensor on a print carriage. Block 310 of method 300 may therefore comprise averaging the measured distances y1, y2 etc.

Figure 4:
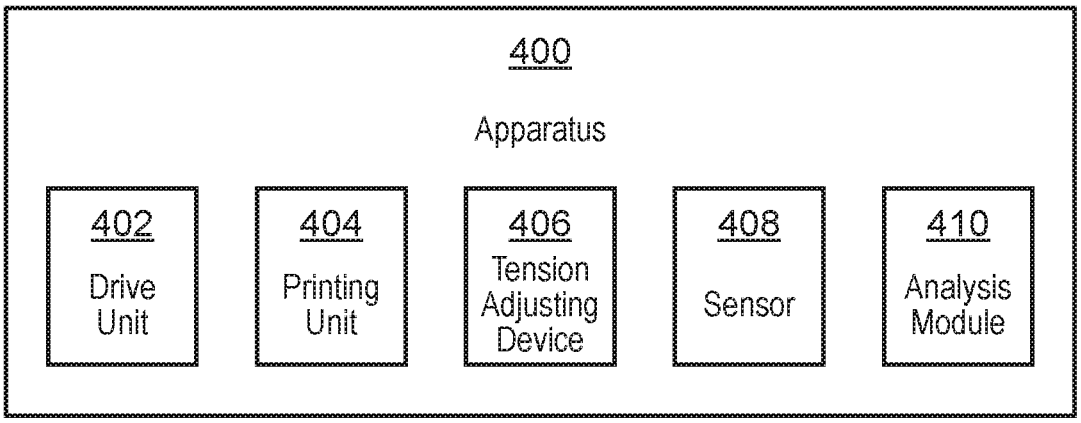
FIG. 4 is a simplified schematic of an example apparatus.

FIG. 4 shows an example apparatus 400. The apparatus 400 comprises a drive unit 402 to advance a substrate by an amount corresponding to a target distance, a printing unit 404 to print a mark on the substrate, a tension adjusting device 406 to adjust the tension of the substrate, a sensor 408 to determine the distance between two marks printed on the substrate, and an analysis module 410. The analysis module 410 is to compare the distance between two marks printed on the substrate to the target distance and, based on the comparison, to issue a signal to the tension adjusting device to adjust the tension of the substrate.

Figure 5:
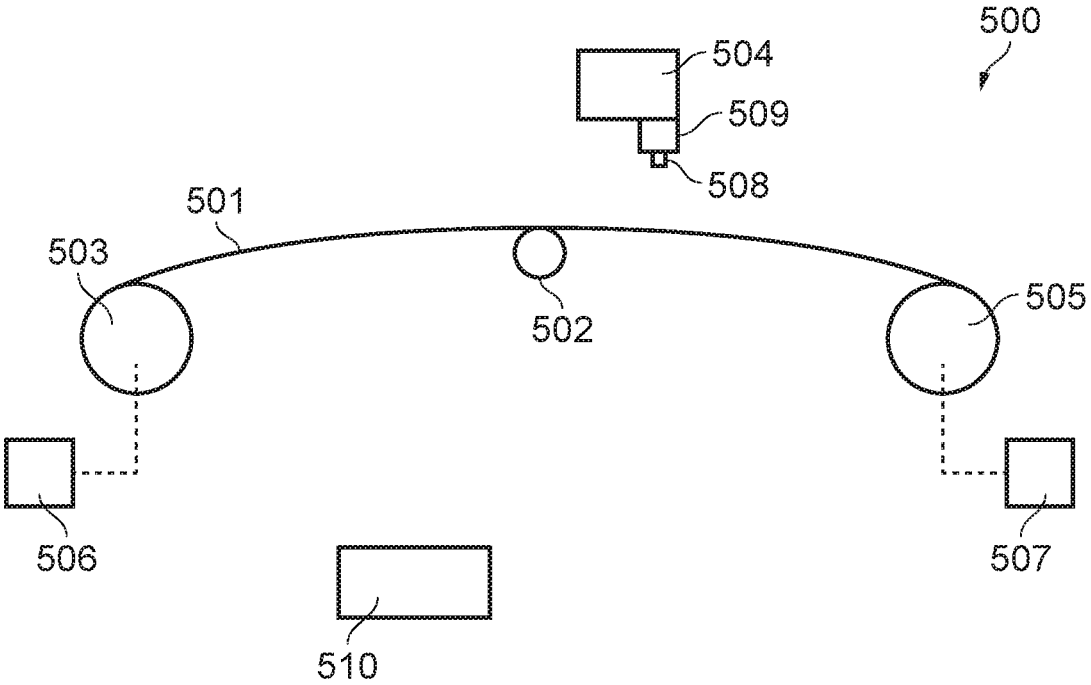
FIG. 5 is a simplified schematic of an example apparatus.

FIG. 5 shows another example apparatus 500. The apparatus 500 comprises a drive unit 502 to advance a substrate 501 from an unwind roller 503 toward a printing unit 504, and to from the printing unit 504 toward a rewind roller 505. The printing unit comprises a moveable print carriage 509 to print a mark onto the substrate 501. For example, the print carriage 509 may be to print a pattern onto the substrate 501, e.g. in a single pass. The print carriage 509 comprises a sensor 508 to determine the distance between two marks printed on the substrate 501. In one example, the sensor 508 is to determine the distance between two marks printed on the substrate, separated in a substrate advance direction, in the direction perpendicular to the substrate advance direction. In this example, the drive unit 502 is proximate the printing unit 504. For example, the drive unit may be disposed prior to the printing unit 504 relative to a substrate advance path (as depicted in the FIG. 5 example).

The substrate 501 comprises an input tension and an output tension. The input tension is the substrate tension between the unwind 501 and the drive unit 502, i.e. the region of the substrate 501 prior to the drive unit 502 and printing station 504. The output tension is the substrate tension between the drive unit 502 and the rewind 505, i.e. the region of the substrate 501 after to the drive unit 502 and printing station 504. The apparatus 500 comprises an input tension adjusting device 506 and an output tension adjusting device 507. The input tension adjusting device 506 is to adjust the input tension of the substrate and the output tension adjusting device 507 is to adjust the output tension of the substrate.

In one example, the input and output tension adjusting devices 506, 507 may be to adjust the input and output tension, respectively if the distance between marks is less than a first threshold (which may in one example be a minimum threshold) or greater than a second threshold (which may in one example be a maximum threshold), In one example the input tension adjusting device 506 may be to reduce the input tension if the input tension is above a minimum value and the output tension adjusting device 507 may be to reduce the output tension if the output tension is above a minimum value. In one example the input tension adjusting device 506 may be to increase the input tension if the output tension is below a minimum value and the output tension adjusting device 507 may be to increase the output tension if the input tension is below a minimum value.

In one example, the input and/or output tension adjusting devices 506, 507 may each comprise a motor (e.g. a DC motor) that, in response to an applied voltage, may change the input and output substrate tensions, respectively. For example, a control system may calculate a voltage (or current) through a respective motor of the input and/or output tension adjusting devices 506, 507 to produce a required torque in the axis of the unwind and rewind rollers 503, 505. Therefore, an applied voltage (e.g. under the control of a controller) to the motor of the input/output tension adjusting devices 506, 507 may adjust the input/output substrate tensions. For example, an increased current through the motor of the output tension adjusting device 507 may result in a higher output substrate tension.

In one example there may be a (not shown) controller associated with the drive unit. The controller may comprise a motor (e.g. a DV) motor and may be to control the advance of the substrate by controller the voltage that is supplied to the drive unit. In one example the motor may comprise a PID servo motor to compute voltage required to advance the substrate by a set distance.

Figure 6:
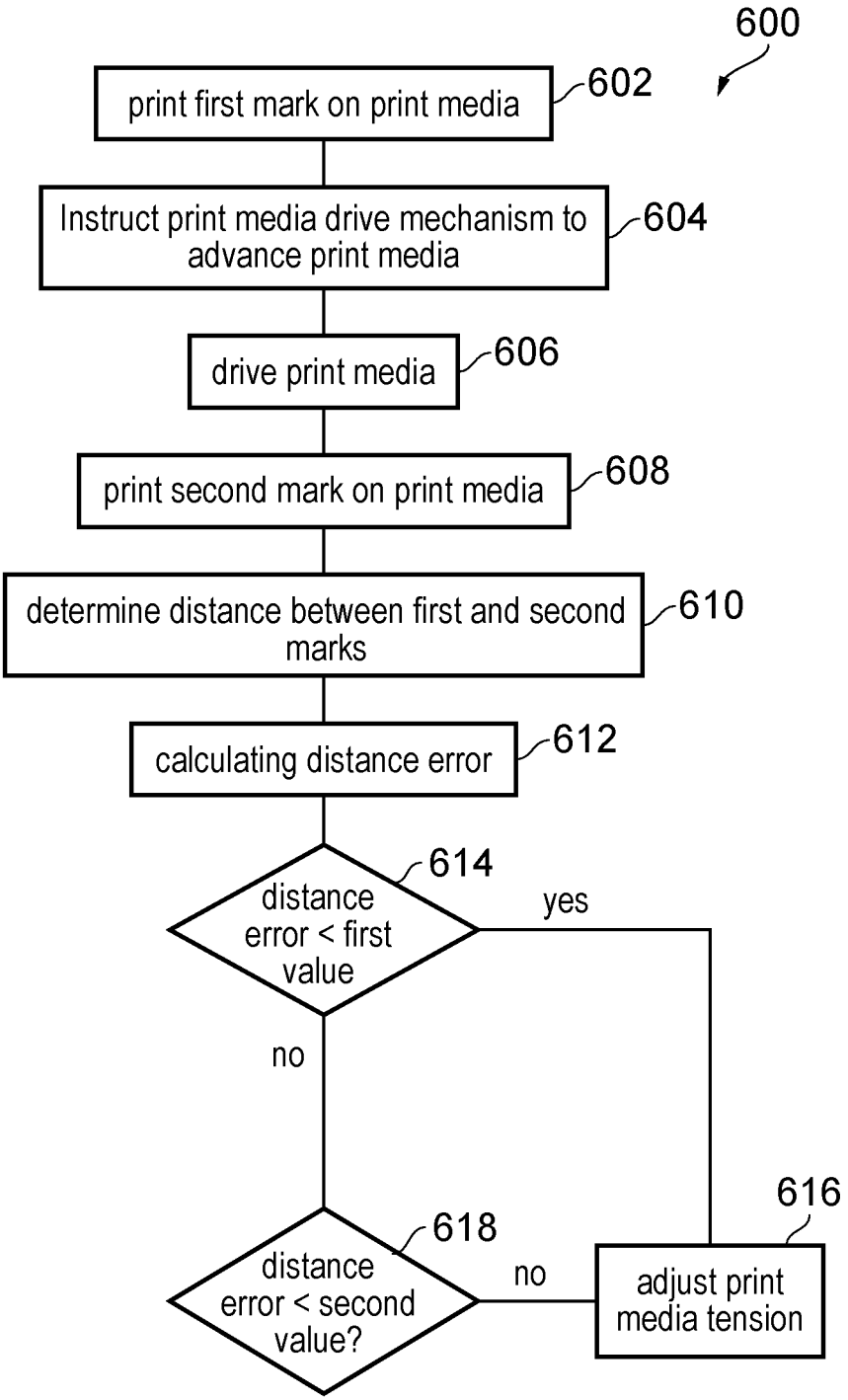
FIG. 6 is a flowchart of an example method.

FIG. 6 shows an example method 600. The method 600 may be a method of adjusting substrate tension, e.g. adjusting substrate tension in a printing system. The method 600 may be a method of calibrating a print system.

The method 600 comprises, at block 602, printing a first mark onto a print media. The first mark may comprise a pattern, or be part of a pattern. For example the first mark may be a 45 degree line, e.g. 45 degrees to a direction of advance of the print media.

The method 600 comprises, at block 604, instructing a print media drive mechanism to drive the print media a predetermined distance. The predetermined distance may be a nominal amount.

The method 600 comprises, at block 606, driving the print media. For example the print media may be driven in a print media advance direction.

The method 600 comprises, at block 608, printing a second mark onto the print media. The second mark may comprise a pattern, or be part of a pattern. For example the second mark may be a 45 degree line, e.g. 45 degrees to a direction of advance of the print media.

The method 600 comprises, at block 610, determining, via a sensor, the distance between the first and second marks. The distance may be a distance between the marks in a direction perpendicular to the print media advance direction.

The method 600 comprises, at block 612, calculating a distance error, the distance error being the difference between the predetermined distance and the distance between the first and second marks. Therefore, the distance error may represent the difference between the amount that the print media advance mechanism was instructed to drive the print media (at block 604) and the amount that the print media actually advances (block 606).

The method 600 comprises, at block 614, comparing the distance error to a first value and determining whether the distance error is less than the first value. If yes, then the method 600 comprises, at block 616, adjusting the tension of the print media. If, at block 614, it is determined no (the distance error is not less than the first value), then the method 600 comprises, at block 618, comparing the distance error to a second value and determining whether the distance error is less than the second value. If no, then the method 600 comprises, at block 616, adjusting the tension of the print media.

In one example, at block 616, following block 614, the print media tension is adjusted until the distance error is above the first value. In one example, at block 616, following block 618, the print media tension is adjusted until the distance error is below the second value. In one example, the print media tension is adjusted until the distance error is within a target range between the first value and the second value. In one example, blocks 602-616 of the method 600 are repeated until the distance error is within a target range defined by the first and second values.

The first value may represent a minimal tension of the print media. The first value may represent a minimal tension so as not to result in wrinkles in the print media. A too-high tension could cause advance errors resulting in horizontal banding and so the second value may represent a maximal tension for the printing system to be calibrated. Therefore, a print media tension within the range defined by the first and second values may represent a print media that is not susceptible to wrinkles (or vertical banding resulting from wrinkles) that can then be calibrated to reduce an advance error. Once the print media tension is adjusted, the method 600 may comprise calibrating the print media, since the adjustment of tension may result in an advance error, which may be corrected for.

Figure 7:
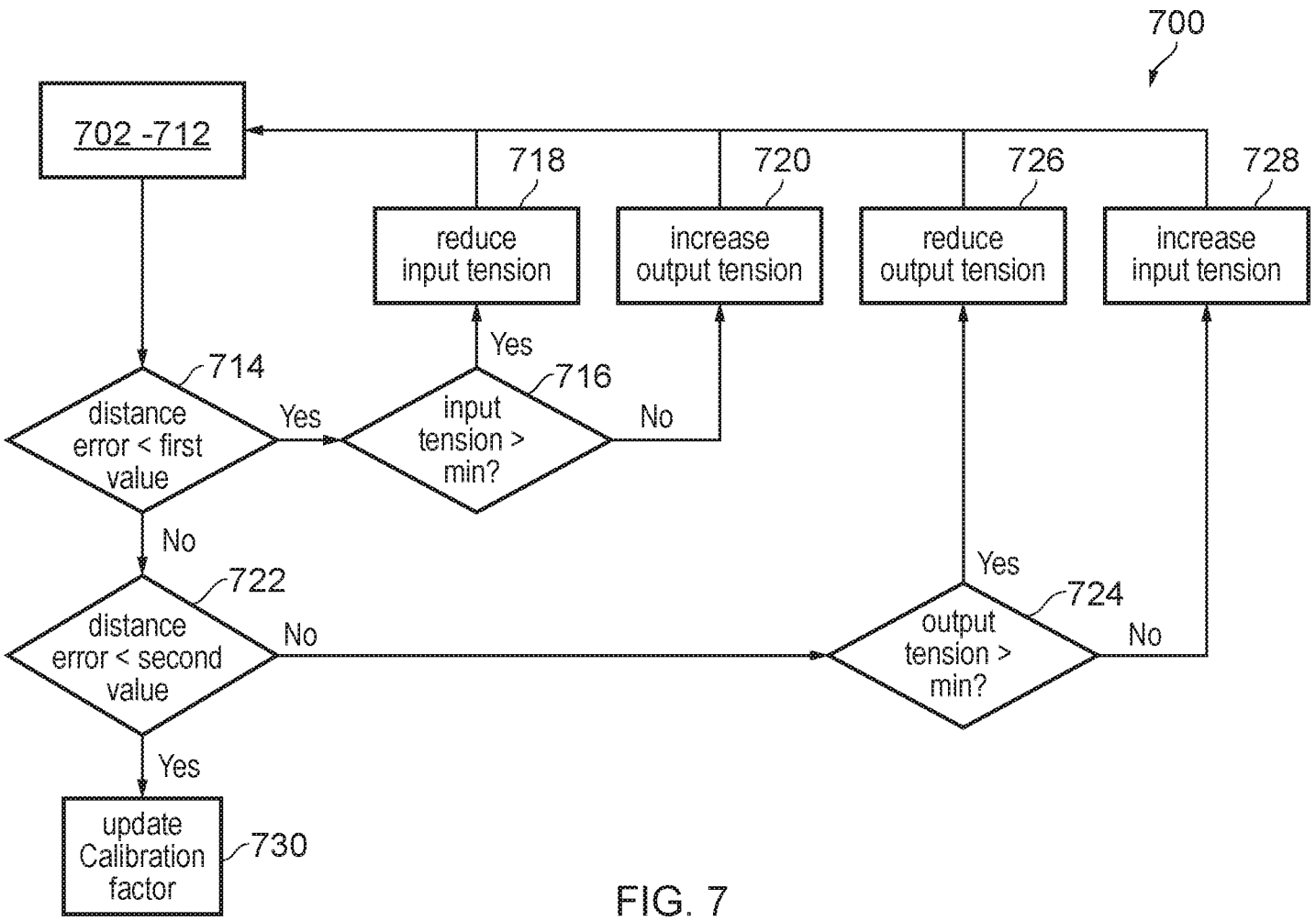
FIG. 7 is a flowchart of an example method.

FIG. 7 shows an example method 700. The method 700 may be a method of adjusting substrate tension, e.g. adjusting substrate tension in a printing system. The method 700 may be a method of calibrating a print system.

Blocks 701-712 of the example method 700 are as for blocks 602-612 of the example of FIG. 6.

The method 700 comprises, at block 714 determining if the distance error is less than a first value. If it is, the method 700 comprises, at block 716, comparing the input tension of the print media to an input tension minimum. If, at block 716, it is determined that the input tension is not less than the minimum (and therefore can still be 'safely' reduced) then the method 700 comprises, at block 718, reducing the input tension. If, at block 716, it is determined that the input tension is less than the minimum tension (and therefore should not be reduced) then the method 700 comprises, at block 720, increasing the output tension thereby forcing an over-advance in the print medium.

After block 718, or 720, blocks 702-712 repeat and then, at block 714, the (new) distance error is compared to the first value. Therefore blocks 702-720 repeat until the distance error is found to be not less than the first value.

If, at block 714, it is determined that the distance error is not less than the first value then the method 700 comprises, at block 722, comparing the distance error to a second value. The second value may be greater than the first. If, at block 722, it is determined that the distance error is not less than the second value then the method 700 comprises, at block 724, comparing the output tension of the print media to an output tension minimum. If, at block 724, it is determined that the output tension is not less than the minimum (and therefore can still be 'safely' reduced) then the method 700 comprises, at block 726, reducing the output tension. If, at block 724, it is determined that the output tension is less than the minimum tension (and therefore should not be reduced) then the method 700 comprises, at block 728, increasing the input tension.

After block 726, or 728, blocks 702-722 repeat and then, at block 722, the (new) distance error is compared to the second value. Therefore, blocks 702-728 repeat until the distance error is found to be less than the second value.

Therefore, the method 700 comprises a repeat of the tension-adjusting blocks until the distance error is within a target range defined by the first and second values. In this way, the method 700 may repeat until the print media is not susceptible to wrinkles or banding.

If, at block 722, it is determined that the distance error is less than the second value then the method 700 comprises, at block 730, updating a calibration factor.

In one example, the calibration factor, at block 730, may be determined based on the distance error. In one example, the calibration factor may be determined based on the distance error and the amount the drive unit was instructed to advance the substrate by. In one example the calibration factor is the advance factor as described above.

Examples herein may automate the tension-adjustment of a substrate such that wrinkles and horizontal banding are avoided. A user with no expertise may also be able to precisely adjust the tensions of the system. Accordingly, print media waste is also reduced, particularly in examples where several advances are performed to evaluate the performance. The number of iterations may also be reduced. The throughout put of print media through a printing system may also be increased, e.g. in low pass modes.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

operating a drive unit to advance a substrate in a substrate advance direction toward a printing station;

printing, at the printing station, a first line and a second line onto the substrate;

instructing the drive unit to advance the substrate in the substrate advance direction by a target amount;

calculating a distance between the first and second lines in a direction perpendicular to the substrate advance direction; and modifying a tension of the substrate based on a difference between the target amount and the calculated distance.

2. The method of claim 1, wherein the first and second lines are angled at approximately 45 degrees to the substrate advance direction.

3. The method of claim 1 further comprising:

printing a first pattern of lines onto the substrate; and printing a second pattern of lines onto the substrate, wherein the first pattern of lines comprises the first line, and the second pattern of lines comprises the second line, and wherein each pattern of lines of the first and second patterns of lines comprises a plurality of lines printed along the substrate in the direction perpendicular to the substrate advance direction; and calculating distances between lines in the first pattern of lines and lines in the second pattern of lines in the direction perpendicular to the substrate advance direction.

4. The method of claim 3, further comprising:

averaging the distances between the lines in the first pattern of lines and the lines in the second pattern of lines to provide an average distance, wherein the modifying of the tension of the substrate is based on a difference between the target amount and the average distance.

5. The method of claim 3, wherein each of the first and second patterns of lines is printed in a single pass of a print carriage.

6. The method of claim 1, wherein the modifying of the tension of the substrate comprises comparing the difference to a first threshold and a second threshold, the second threshold being greater than the first threshold, and adjusting the tension of the substrate in response to the difference being less than the first threshold or greater than the second threshold.

7. The method of claim 1, wherein the substrate has a first substrate tension in a region of the substrate before the printing station and a second substrate tension in a region of the substrate after the printing station, and wherein the modifying of the tension of the substrate comprises comparing the difference to a first threshold and a second threshold, the second threshold being greater than the first threshold, the method comprising:

adjusting the first substrate tension of the substrate in response to the difference being less than the first threshold or adjusting the second substrate tension of the substrate in response to the difference being greater than the second threshold.

8. The method of claim 1, further comprising:

calibrating the drive unit.

9. The method of claim 1, wherein each of the first line and the second line is angled with respect to the substrate advance direction.

10. The method of claim 9, wherein the second line is at an offset relative to the first line in the substrate advance direction.

11. The method of claim 6, comprising:

calculating the difference by subtracting the target amount from the calculated distance;

in response to the difference being a negative value and being less than the first threshold, modifying the tension of the substrate in a region of the substrate before the printing station; and in response to the difference being a positive value and greater than the second threshold, modifying the tension of the substrate in a region of the substrate after the printing station.

12. An apparatus comprising:

a drive unit to advance a substrate by an amount corresponding to a target distance;

a printing unit to print a mark on the substrate;

a tension adjusting assembly to adjust a tension of the substrate, wherein the tension adjusting assembly comprises:

an input tension adjusting device to adjust the tension of the substrate in a region of the substrate prior to the printing unit, and an output tension adjusting device to adjust the tension of the substrate in a region of the substrate after the printing unit;

a sensor to determine a distance between two marks printed on the substrate;

an analysis module to compare the distance between the two marks printed on the substrate to the target distance and, based on the comparison, issue a signal to the tension adjusting assembly to adjust the tension of the substrate.

13. The apparatus of claim 12, wherein the drive unit is proximate the printing unit, and wherein the sensor is located on the printing unit.

14. The apparatus of claim 12, wherein the analysis module is to:

compute a difference between the distance between the two marks and the target distance, compare the difference to a first threshold, and in response to the difference being less than the first threshold, issue the signal to the input tension adjusting device to adjust the tension of the substrate in the region of the substrate prior to the printing unit.

15. The apparatus of claim 14, wherein the analysis module is to:

in response to the difference not being less than the first threshold, compare the difference to a second threshold, the second threshold being greater than the first threshold, and in response to the difference being greater than the second threshold, issue the signal to the output tension adjusting device to adjust the tension of the substrate in the region of the substrate after to the printing unit.

16. The apparatus of claim 12, wherein the drive unit is to advance the substrate by the amount corresponding to the target distance in a substrate advance direction, and wherein the distance between the two marks is in a direction perpendicular to the substrate advance direction.

17. A method comprising:

printing a first mark onto a print media;

instructing a print media drive mechanism to drive the print media a predetermined distance;

driving the print media;

printing a second mark onto the print media;

determining, using a sensor, a distance between the first and second marks;

calculating a distance error that is a difference between the predetermined distance and the distance between the first and second marks;

comparing the distance error to a first value; and if the distance error is less than the first value, adjusting a tension of the print media, and, otherwise, comparing the distance error to a second value, the second value being greater than the first value, and, if the distance error is greater than the second value, adjusting the tension of the print media.

18. The method of claim 17, wherein the print media comprises an input tension, that is the tension of the print media in a region of the print media prior to the print media drive mechanism, and an output tension that is the tension of the print media in a region of the print media after the print media drive mechanism, and wherein, if the distance error is less than the first value, the method further comprises:

comparing the input tension to a minimum input tension value and, if the input tension is greater than the minimum input tension value, reducing the input tension and, otherwise, increasing the output tension.

19. The method of claim 17, wherein the print media comprises an input tension, that is the tension of the print media in a region of the print media prior to the print media drive mechanism, and an output tension that is the tension of the print media in a region of the print media after the print media drive mechanism, and wherein, if the distance error is greater than the second value, the method further comprises:

comparing the output tension to a minimum output tension value and, if the output tension is greater than the minimum output tension value, reducing the output tension and, otherwise, increasing the input tension.

20. The method of claim 17, wherein, if the distance error is greater than the first value and less than the second value, the method further comprises:

calibrating the print media drive mechanism.

* * * * *